US010281940B2

(12) United States Patent
Yang et al.

(10) Patent No.: US 10,281,940 B2
(45) Date of Patent: May 7, 2019

(54) LOW DROPOUT REGULATOR WITH DIFFERENTIAL AMPLIFIER

(71) Applicant: PIXART IMAGING INC., Hsin-Chu (TW)

(72) Inventors: Tsung-Han Yang, Hsin-Chu (TW); Chia-So Chuang, Hsin-Chu (TW)

(73) Assignee: PIXART IMAGING INC., Hsin-Chu (TW)

( * ) Notice: Subject to any disclaimer, the term of this patent is extended or adjusted under 35 U.S.C. 154(b) by 0 days.

(21) Appl. No.: 15/725,579

(22) Filed: Oct. 5, 2017

(65) Prior Publication Data

US 2019/0107855 A1 Apr. 11, 2019

(51) Int. Cl.

| | |
|---|---|
| ***G05F 1/575*** | (2006.01) |
| ***G05F 1/59*** | (2006.01) |
| *G05F 1/56* | (2006.01) |

(52) U.S. Cl.

CPC ..... *G05F 1/575* (2013.01); *G05F 1/59* (2013.01); *G05F 1/56* (2013.01)

(58) Field of Classification Search

CPC ..... G05F 1/56; G05F 1/575; G05F 1/59
USPC ..... 323/269–280
See application file for complete search history.

(56) References Cited

U.S. PATENT DOCUMENTS

| | | | | |
|---|---|---|---|---|
| 3,638,132 | A * | 1/1972 | Trilling | H03F 3/45071 330/260 |
| 4,988,654 | A * | 1/1991 | Kennedy | B01J 37/04 208/216 PP |
| 7,719,241 | B2 * | 5/2010 | Dean | G05F 1/46 323/273 |
| 9,182,770 | B2 * | 11/2015 | Groeneweg | G05F 1/575 |
| 9,323,266 | B2 * | 4/2016 | Ozanoglu | G05F 1/575 |
| 9,477,246 | B2 * | 10/2016 | Agarwal | G05F 1/575 |
| 2002/0149398 | A1 * | 10/2002 | Ingino, Jr. | G05F 1/575 327/52 |
| 2007/0210770 | A1 * | 9/2007 | Dean | G05F 1/46 323/273 |
| 2015/0177760 | A1 * | 6/2015 | Ozanoglu | G05F 1/575 323/273 |
| 2017/0090497 | A1 * | 3/2017 | Hamlyn | G05F 1/575 |

* cited by examiner

*Primary Examiner* — Matthew V Nguyen
*Assistant Examiner* — Nusrat Quddus
(74) *Attorney, Agent, or Firm* — Li & Cai Intellectual Property (USA) Office

(57) ABSTRACT

A low dropout regulator provided includes: an impedance unit; a differential amplifier being electrically connected to the impedance unit; a current mirror unit being electrically connected to the differential amplifier; and an adaptive bias unit being electrically connected to the differential amplifier and the current mirror unit. The impedance unit is electrically connected to a negative feedback route of the differential amplifier to make a gain of the negative feedback route greater than a gain of a positive feedback route of the differential amplifier.

10 Claims, 2 Drawing Sheets

LOW DROPOUT REGULATOR WITH DIFFERENTIAL AMPLIFIER

FIELD OF THE INVENTION

The present disclosure relates to a low dropout regulator, and more particularly to a low dropout regulator with an impedance unit electrically connected to a negative feedback route of a differential amplifier in the low dropout regulator.

BACKGROUND OF THE INVENTION

A low-dropout regulator (LDO) is a type of voltage regulator that is widely utilized in power management integrated circuits, satisfying the requirements of low-noise and precision supply voltage. Local LDOs may be used to reduce cross talk, improve voltage regulation and eliminate voltage spikes.

The LDO regulator with a greater gain may have better system accuracy. However, a greater gain may also decrease system stability in the LDO regulator for increasing load current and lowering load resistance.

Therefore, an improved LDO regulator needs to be provided to obtain greater gain without largely decreasing stability thereof.

SUMMARY OF THE INVENTION

One aspect of the present disclosure relates to a low dropout regulator with an impedance unit electrically connected to a negative feedback route of a differential amplifier in the low dropout regulator.

One of the embodiments of the present disclosure provides a low dropout regulator including: an impedance unit; a differential amplifier being electrically connected to the impedance unit; a current mirror unit being electrically connected to the differential amplifier; and an adaptive bias unit being electrically connected to the differential amplifier and the current mirror unit. The impedance unit is electrically connected to a negative feedback route of the differential amplifier to make a gain of the negative feedback route greater than a gain of a positive feedback route of the differential amplifier.

Another one of the embodiments of the present disclosure provides a low dropout regulator including: an impedance unit; a differential amplifier being electrically connected to an impedance unit; and an adaptive bias unit being electrically connected to the differential amplifier. The impedance unit is electrically connected to a negative feedback route of the differential amplifier to make a gain of the negative feedback route greater than a gain of a positive feedback route of the differential amplifier.

Yet another one of the embodiments of the present disclosure provides a low dropout regulator including: an impedance unit; and a differential amplifier with symmetric structure, the differential amplifier being electrically connected to an impedance unit. The impedance unit is electrically connected to a negative feedback route of the differential amplifier to make a gain of the negative feedback route greater than a gain of a positive feedback route of the differential amplifier.

Therefore, the LDO regulator of the present invention can obtain greater gain without largely decreasing stability through the impedance unit.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Embodiments of an LDO regulator according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

Figure 1:
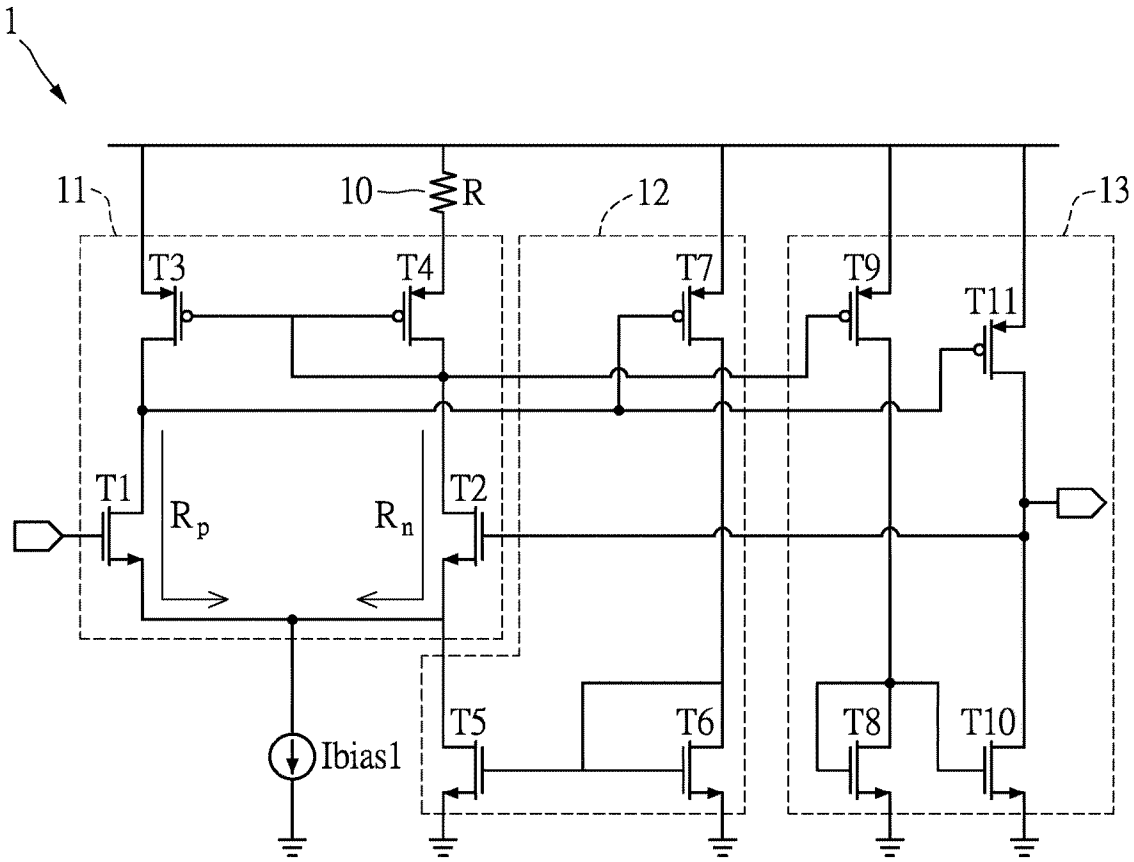
FIG. 1 shows a circuit diagram of the low dropout regulator according to the embodiment of the present disclosure.

Referring to FIG. 1, which shows a circuit diagram of the low dropout regulator according to the embodiment of the present disclosure. As shown in FIG. 1, a low dropout regulator 1 includes: an impedance unit 10, the impedance unit 10 being a resistor in the embodiment; a differential amplifier 11 with symmetric structure, the differential amplifier 11 being electrically connected to an impedance unit 10; a current mirror unit 12 being electrically connected to the differential amplifier 11; and an adaptive bias unit 13 being electrically connected to the differential amplifier 11 and the current mirror unit 12. The impedance unit 10 is electrically connected to a negative feedback route Rn of the differential amplifier 11 to make a gain Gn of the negative feedback route Rn greater than a gain Gp of a positive feedback route Rp of the differential amplifier 11.

The differential amplifier 11 includes: a first transistor T1 having a source electrode, a drain electrode, and a gate electrode; a second transistor T2 having a source electrode connected to the source electrode of the first transistor T1; a third transistor T3 having a drain electrode connected to the drain electrode of the first transistor T1; and a fourth transistor T4 having a gate electrode connected to a gate electrode of the third transistor T3 and connected to a drain electrode of the fourth transistor T4, a source electrode connected to the impedance unit 10, and a drain electrode connected to the gate electrode of the fourth transistor T4 and a drain electrode of the second transistor T2. The source electrode of the first transistor T1 and the source electrode of the second transistor T2 are connected to a first bias current Ibias1.

The current mirror unit 12 includes: a fifth transistor T5 having a drain electrode connected to the source electrode of the second transistor T2; a sixth transistor T6 having a gate electrode connected to a gate electrode of the fifth transistor T5 and connected to a drain electrode of the sixth transistor T6; and a seventh transistor T7 having a gate electrode connected to the drain electrode of the third transistor T3 and a drain electrode connected to the drain electrode of the sixth electrode T6.

The adaptive bias unit 13 includes: an eighth transistor T8 having a gate electrode connected to a drain electrode of the eighth transistor T8; a ninth transistor T9 having a gate electrode connected to the gate electrode of the third electrode T3 and a drain electrode connected to the drain electrode of the eighth transistor T8; a ninth transistor T9 having a gate electrode connected to the gate electrode of the third electrode T3 and a drain electrode connected to the drain electrode of the eighth transistor T8; a tenth transistor T10 having a drain electrode connected to the gate electrode of the second transistor T2 and a gate electrode connected to the drain electrode of the eighth transistor T8; and an eleventh transistor T11 having a gate electrode connected to the drain electrode of the third transistor T3 and a drain electrode connected to the drain electrode of the tenth transistor T10.

The impedance unit 10 in the low dropout regulator 1 may increase the ratio of Gn to Gp, and thus further decrease the noise, and achieve the effect of obtaining greater gain without largely decreasing stability.

Figure 2:
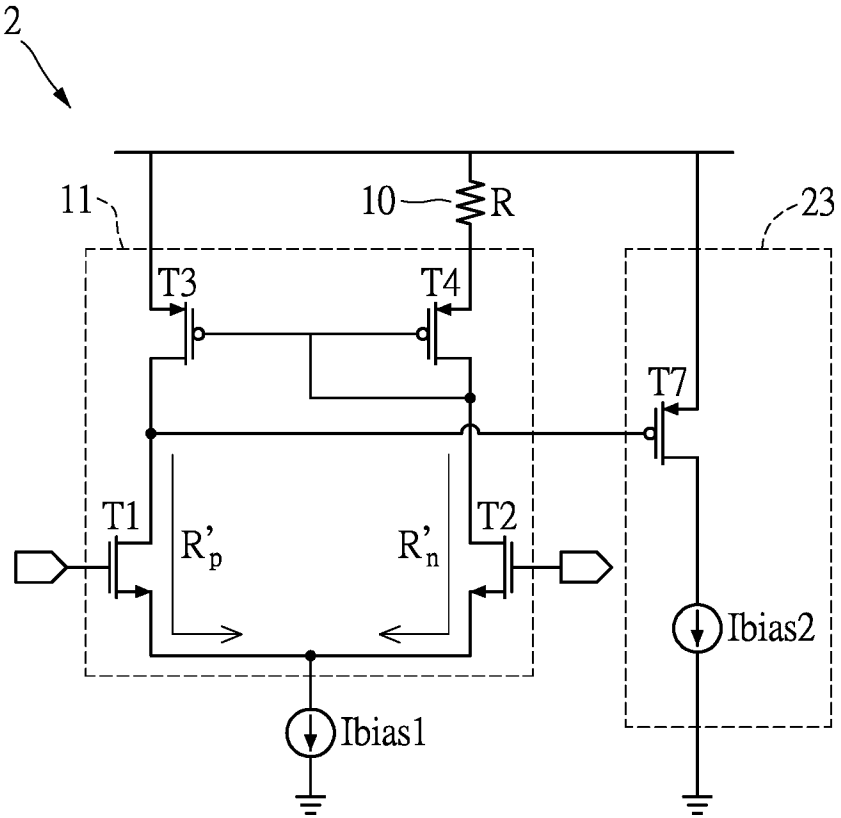
FIG. 2 shows a circuit diagram of a low dropout regulator according to another embodiment of the present disclosure.

Referring to FIG. 2, a circuit diagram of a low dropout regulator according to another embodiment of the present disclosure is shown. A low dropout regulator 2 includes: an impedance unit 10, the impedance unit 10 being a resistor in the embodiment; an differential amplifier 11 with symmetric structure, the differential amplifier 11 being electrically connected to an impedance unit 10; and an adaptive bias unit 23 being electrically connected to the differential amplifier 11. The impedance unit 10 is electrically connected to a negative feedback route Rn' of the differential amplifier 11 to make a gain Gn' of the negative feedback route Rn' greater than a gain Gp' of a positive feedback route Rp' of the differential amplifier 11.

The differential amplifier 11 includes: a first transistor T1 having a source electrode, a drain electrode, and a gate electrode; a second transistor T2 having a source electrode connected to the source electrode of the first transistor T1; a third transistor T3 having a drain electrode connected to the drain electrode of the first transistor T1; and a fourth transistor T4 having a gate electrode connected to a gate electrode of the third transistor T3 and connected to a drain electrode of the fourth transistor T4, a source electrode connected to the impedance unit 10, and a drain electrode connected to the gate electrode of the fourth transistor T4 and a drain electrode of the second transistor T2. The source electrode of the first transistor T1 and the source electrode of the second transistor T2 are connected to a first bias current Ibias1.

The adaptive bias unit 23 includes a seventh transistor T7 having a gate electrode connected to the drain electrode of the third transistor T3 and a drain electrode connected to a second bias current Ibias2.

Similar to the embodiment shown in FIG. 1, the impedance unit 10 in the low dropout regulator 2 may increase the ratio of Gn' to Gp', and thus further decrease the noise, achieving the effect of obtaining greater gain without largely decreasing stability.

Therefore, the low dropout regulators 1, 2 of the present invention may obtain greater gain without largely decreasing stability through the impedance unit 10.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. A low dropout regulator comprising:

an impedance unit;

a differential amplifier being electrically connected to the impedance unit;

a current mirror unit being electrically connected to the differential amplifier; and an adaptive bias unit being electrically connected to the differential amplifier and the current mirror unit;

wherein the impedance unit is electrically connected to a negative feedback route of the differential amplifier to make a gain of the negative feedback route greater than a gain of a positive feedback route of the differential amplifier.

2. The low dropout regulator of claim 1, wherein the differential amplifier includes:

a first transistor having a source electrode, a drain electrode, and a gate electrode;

a second transistor having a source electrode connected to the source electrode of the first transistor;

a third transistor having a drain electrode connected to the drain electrode of the first transistor; and a fourth transistor having a gate electrode connected to a gate electrode of the third transistor and connected to a drain electrode of the fourth transistor, a source electrode connected to the impedance unit, and a drain electrode connected to the gate electrode of the fourth transistor and a drain electrode of the second transistor;

wherein the source electrode of the first transistor and the source electrode of the second transistor are connected to a first bias current.

3. The low dropout regulator of claim 2, wherein the current mirror unit includes:

a fifth transistor having a drain electrode connected to the source electrode of the second transistor;

a sixth transistor having a gate electrode connected to a gate electrode of the fifth transistor and connected to a drain electrode of the sixth transistor; and a seventh transistor having a gate electrode connected to the drain electrode of the third transistor and a drain electrode connected to the drain electrode of the sixth electrode.

4. The low dropout regulator of claim 3, wherein the adaptive bias unit includes:

an eighth transistor having a gate electrode connected to a drain electrode of the eighth transistor; and a ninth transistor having a gate electrode connected to the gate electrode of the third electrode and a drain electrode connected to the drain electrode of the eighth transistor.

5. The low dropout regulator of claim 3, wherein the adaptive bias unit includes:

an eighth transistor having a source electrode, a drain electrode, and a gate electrode;

a ninth transistor having a gate electrode connected to the gate electrode of the third electrode and a drain electrode connected to the drain electrode of the eighth transistor;

a tenth transistor having a drain electrode being connected to the gate electrode of the second transistor and a gate electrode being connected to the drain electrode of the eighth transistor; and an eleventh transistor having a gate electrode connected to the drain electrode of the third transistor and a drain electrode connected to the drain electrode of the tenth transistor.

6. The low dropout regulator of claim 1, wherein the impedance unit is a resistor.

7. A low dropout regulator comprising:

an impedance unit;

a differential amplifier being electrically connected to the impedance unit; and an adaptive bias unit being electrically connected to the differential amplifier;

wherein the impedance unit is electrically connected to a negative feedback route of the differential amplifier to make a gain of the negative feedback route greater than a gain of a positive feedback route of the differential amplifier, wherein the differential amplifier includes:

a first transistor having a source electrode, a drain electrode, and a gate electrode;

a second transistor having a source electrode connected to the source electrode of the first transistor;

a third transistor having a drain electrode connected to the drain electrode of the first transistor; and a fourth transistor having a gate electrode connected to a gate electrode of the third transistor, a drain electrode connected to the gate of the fourth transistor and a drain electrode of the second transistor connected to the impedance unit;

wherein the source electrode of the first transistor and the source electrode of the second transistor are connected to a first bias current.

8. The low dropout regulator of claim 7, wherein the adaptive bias unit includes:

a seventh transistor having a gate electrode connected to the drain electrode of the third transistor and a drain electrode connected to a second bias current.

9. The low dropout regulator of claim 7, wherein the impedance unit is a resistor.

10. A low dropout regulator comprising:

an impedance unit; and a differential amplifier with symmetric structure, the differential amplifier being electrically connected to an impedance unit;

wherein the impedance unit is electrically connected to a negative feedback route of the differential amplifier to make a gain of the negative feedback route greater than a gain of a positive feedback route of the differential amplifier, and wherein the differential amplifier includes:

a first transistor having a source electrode, a drain electrode, and a gate electrode;

a second transistor having a source electrode connected to the source electrode of the first transistor;

a third transistor having a drain electrode connected to the drain electrode of the first transistor; and a fourth transistor having a gate electrode connected to a gate electrode of the third transistor, a drain electrode connected to the gate of the fourth transistor and a drain electrode of the second transistor connected to the impedance unit;

wherein the source electrode of the first transistor and the source electrode of the second transistor are connected to a first bias current.

* * * * *